US007406917B2

(12) United States Patent
Naumann et al.

(10) Patent No.: US 7,406,917 B2
(45) Date of Patent: Aug. 5, 2008

(54) DEVICE FOR FASTENING A COVERING ON A CYLINDER OF A ROTARY PRESS

(75) Inventors: Reinhard Naumann, Schkeuditz/Wolteritz (DE); Frank Oertel, Langenwetzendorf (DE)

(73) Assignee: manroland AG, Offenbach am Main (DE)

( * ) Notice: Subject to any disclaimer, the term of this patent is extended or adjusted under 35 U.S.C. 154(b) by 0 days.

(21) Appl. No.: 11/725,280

(22) Filed: Mar. 19, 2007

(65) Prior Publication Data

US 2007/0214985 A1 Sep. 20, 2007

(30) Foreign Application Priority Data

Mar. 17, 2006 (DE) ..... 10 2006 012 760

(51) Int. Cl.
*B41F 27/12* (2006.01)

(52) U.S. Cl. ..... 101/415.1; 101/378

(58) Field of Classification Search ..... 101/415.1, 101/378

See application file for complete search history.

(56) References Cited

U.S. PATENT DOCUMENTS

| | | | | |
|---|---|---|---|---|
| 4,421,024 | A * | 12/1983 | Burger et al. | 101/415.1 |
| 5,485,783 | A | 1/1996 | Gunnar | |
| 6,401,617 | B1 * | 6/2002 | Lyndhurst | 101/415.1 |
| 6,578,484 | B2 * | 6/2003 | Fusco | 101/415.1 |
| 7,334,522 | B2 * | 2/2008 | Burger et al. | 101/415.1 |
| 2006/0150845 | A1 * | 7/2006 | Zahnd et al. | 101/415.1 |

FOREIGN PATENT DOCUMENTS

| | | |
|---|---|---|
| DE | 196 06 744 | 8/1997 |
| DE | 197 03 290 | 8/1998 |
| DE | 20 2004 020 725 | 12/2005 |

OTHER PUBLICATIONS

Search Report dated Mar. 17, 2006 issued for the corresponding German Application No. 10 2006 012 760.9.

* cited by examiner

*Primary Examiner*—Leslie J Evanisko
(74) *Attorney, Agent, or Firm*—Cohen Pontani Lieberman & Pavane LLP

(57) ABSTRACT

A printing cylinder having an axis-parallel channel in the cylinder, the channel narrowing toward the surface to form a slot for receiving the ends of a covering; a clamping member arranged in the channel and urged toward the slot by springs, the clamping member having at least one recess facing a respective at least one wall of the channel; and at least one supporting element arranged inside the channel and engaging a respective recess of the clamping member. A pair of adjusting elements arranged at the ends of the cylinder support the clamping member so that the clamping member can be radially displaced, the adjusting elements being arranged so that movement of the adjusting elements causes relative movement between the supporting element and the clamping member, whereby the clamping member is caused to move radially for clamping and unclamping the ends of the covering in the slot.

6 Claims, 5 Drawing Sheets

DEVICE FOR FASTENING A COVERING ON A CYLINDER OF A ROTARY PRESS

BACKGROUND OF THE INVENTION

1. Field of the Invention

The invention concerns a device for fastening a covering on a cylinder of a rotary printing press including at least one axially parallel channel in the cylinder, the channel forming a slot into which the ends of a covering can be inserted and removed, and a clamping member, which is arranged in the channel and is pressed radially toward the slot by means of several compression springs for fastening the covering, wherein adjusting elements, by which the clamping member is supported in a way that allows it to be radially displaced, are arranged at the ends of the cylinder.

2. Description of the Related Art

DE 197 03 290 A1 discloses a device for fastening a covering on an impression cylinder of a rotary press. In this known device, a clamping member within an axially parallel channel of the cylinder body is pressed by compression springs radially outward against the walls of the channel to fix a covering between the channel walls and the clamping member. To clamp and unclamp the covering, the clamping member is adjusted radially towards the inside of the cylinder by setscrews located at its outer ends. In this clamped and unclamped position, the compression springs cause a deflection of the clamping rail towards the outside of the cylinder between the setscrews located at the ends.

Precisely in the case of narrow cylinders, such as one plate-around, double-width impression cylinders, the size or the diameter of the channel bore is limited. Due to the limited channel diameter, the size of the clamping rail and thus its stiffness are limited accordingly. If the clamping member is adjusted radially towards the inside of the cylinder by setscrews located at its outer ends for the purpose of clamping or bracing the covering, the convexity of the deflected clamping rail in the center region of the cylinder can project so close to the channel wall that the covering cannot be released or inserted.

SUMMARY OF THE INVENTION

Therefore, an object of the invention is to provide a device for fastening a covering on a cylinder of a rotary press in such a way that deflection of the clamping rail during release of the clamping is avoided.

The inventors realized that it is possible to prevent the deflection of the clamping rail during the clamping or the unclamping of a covering if, in addition to the clamping rail, supporting elements are arranged in the lockup channel in such a way that the supporting elements act as a mechanical barrier to the deflection of the clamping rail, and at the same time the force resulting from the deflection is diverted towards the inside wall of the channel by the supporting elements.

According to the invention, at least one supporting element is arranged inside the channel along with the clamping member. This supporting element engages in at least one recess in the clamping member, so that the movement of the adjusting elements causes relative movement between the supporting element and the clamping member.

In this design of the device for fastening a covering on a cylinder, if the supporting element is displaced by the adjusting element in the direction of the channel bore, then this displacement movement leads to relative movement between the clamping member and the supporting element in the radial direction of the channel bore when the recess is suitably designed, e.g., an oblong hole. The supporting element is pressed against the wall of the channel bore and causes the clamping member to be lowered from the fixed position of the covering. Deflection of the clamping member is prevented by the support of the supporting element in the channel bore.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

The present invention is described below with reference to FIGS. 1 to 4.

Figure 1:
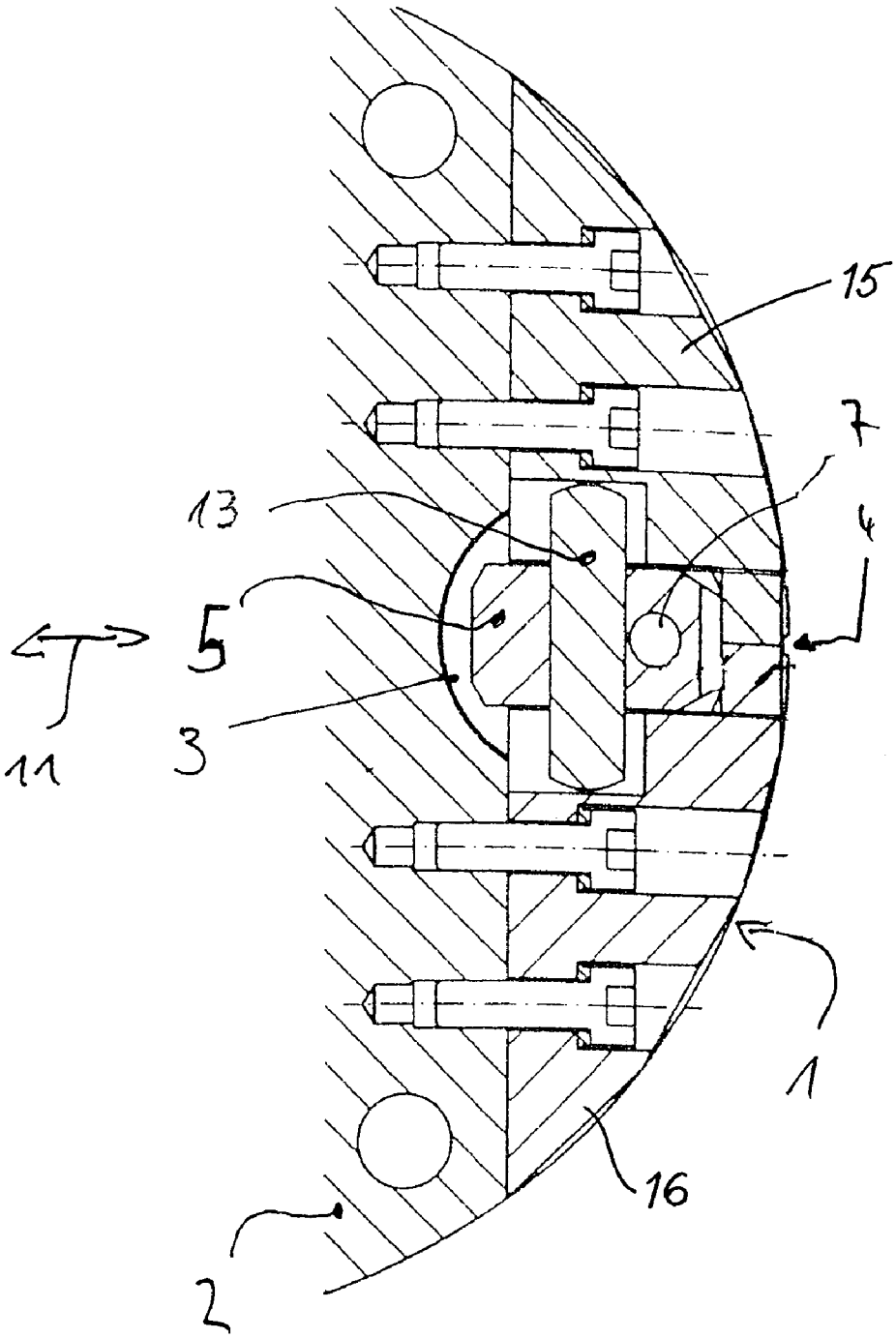
FIG. 1 shows a cross-sectional view of a segment of a cylinder with the new clamping device.

FIG. 1 shows a segment of a cylinder 2 with a new clamping device of the invention in a vertical cross-sectional view through the axis of rotation of the cylinder. The cylinder 2 can be either a plate cylinder, which carries one or more printing plates, or a transfer cylinder, which carries one or more rubber blankets on the surface of the cylinder as a packing or as a covering 1. So that the ends of the covering 1 can be fastened to the cylinder 2, a lockup channel 3 extending in the axial direction is formed in the cylinder 2 between support plates 15, 16 which form part of the cylinder. The lockup channel 3 forms a slot 4 in the surface of the cylinder, and the covering 1 is inserted in or removed from this slot 4. The ends of the covering 1 can be clamped between the inside wall of the channel and the clamping member 5 by means of spring elements (not shown). The clamping member 5 is movably supported in the radial direction 11 for clamping or unclamping the covering 1. The clamping member 5 can be displaced in the direction of the channel by an adjusting element 7, here a pin or a setscrew, which can be moved parallel to the axis of rotation of the cylinder. This results in movement of the clamping member 5 relative to the supporting elements (not shown). In this connection, a positioning pin 13, which is movably supported in an oblong hole 14, can make it possible for the clamping member 5 to move only in the radial direction 11 of the cylinder.

Figure 1A:
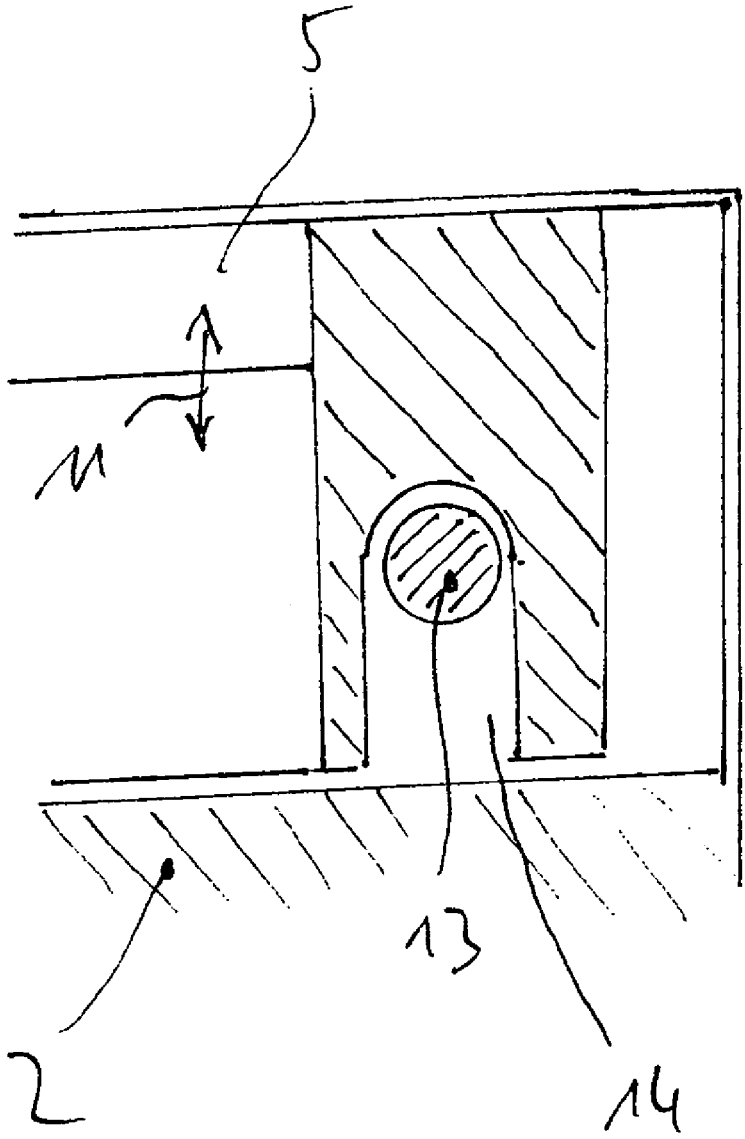
FIG. 1*a* shows a cross section through a positioning pin and clamping member.

FIG. 1*a* shows a cross section through the positioning pin 13 and the clamping member 5. The positioning pin 13 is supported in oblong hole 14, so that only radial movement 11 of the clamping member 5 is permitted, and axial movement in the direction of the channel is prevented.

Figure 2:
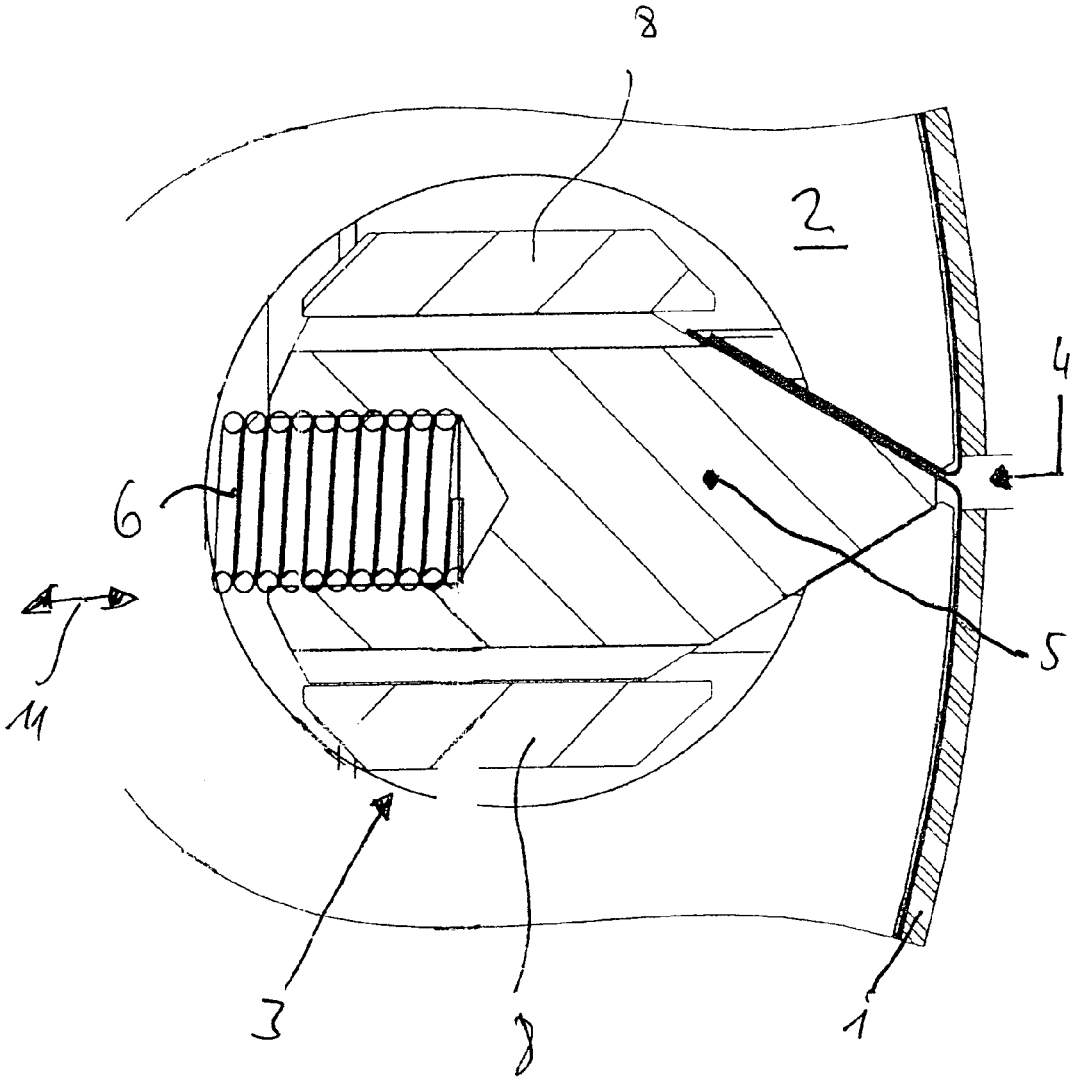
FIG. 2 shows a cross-sectional view of another design of the new clamping device.

FIG. 2 shows a cross-sectional view through the lockup channel 3, which is formed as a bore, and another design of the new clamping device. The covering 1 is a blanket positioned on a carrier plate. The two ends of the carrier plate are pressed against the inside wall of the channel by the clamping member 5, so that the blanket is clamped to the circumference of the cylinder 2. In this connection, the clamping member 5 is pressed from the base of the lockup channel 3 in the direction of the slot 4 by means of compression springs 6. The clamping member 5 has two sidepieces that run conically in the direction of the slot 4, and the two ends of the carrier plate in FIG. 2 are clamped on the upper side. Supporting elements 8, which are joined with one another by joining elements and recesses (not shown) in the clamping member 5, are mounted in the lockup channel 3 above and below the clamping member 5. If the clamping member 5 is moved in the direction of the channel bore by an adjusting element (not shown), then this adjusting movement results in relative movement between the clamping member 5 and the supporting element 8 in the radial direction 11 of the channel bore, if the recess is suitably designed, e.g., as an oblong hole. The supporting element is pressed against the wall of the channel bore and causes the clamping member to be lowered from the fixed position of the covering 1. Deflection of the clamping member 5 is prevented by the support of the supporting element 8 in the channel bore.

Figure 3:
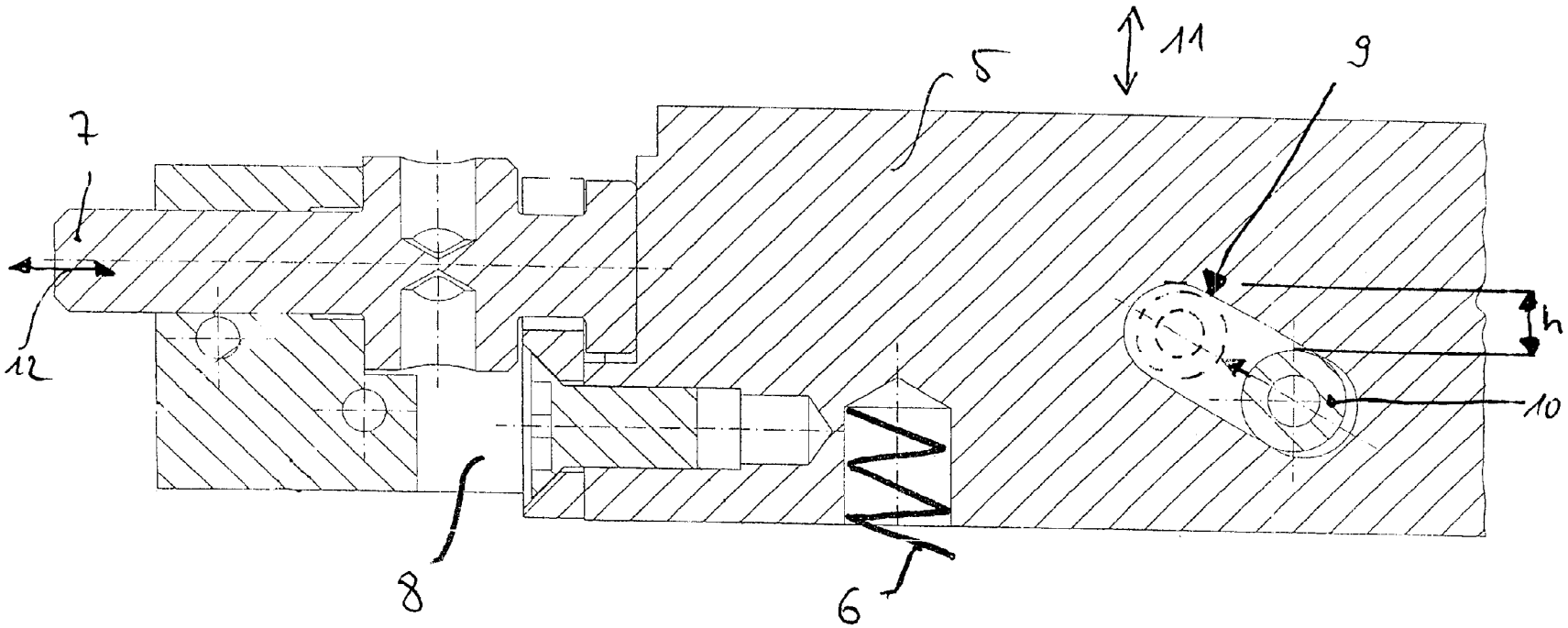
FIG. 3 shows a detail top view of a clamping member with slot and adjusting element.

FIG. 3 shows a top view of a segment of a clamping member 5 in the longitudinal direction of the lockup channel. A pin-like adjusting element 7 is threaded and can be moved in direction 12, in this case, parallel to the axis of the cylinder. In this embodiment, the clamping member 5 has an oblong hole 9 with an oblique inclination. The supporting elements 8 (shown only partially) are joined with one another through the oblong hole 9 by means of a pin 10. When the adjusting element 7 is then moved to the right, the supporting elements 8 are pressed against the wall of the channel bore, and the clamping member 5 is lowered by the vertical distance h, so that the slot on the cylinder is released for clamping or unclamping. In the lowered state, the pin would be in the upper position of the oblong hole 9 (indicated by broken lines). The positioning pin described in connection with FIG. 1*a* allows only radial movement 11 of the clamping member 5, whereas the supporting elements 8 can be displaced axially within the channel bore 3.

Figure 4:
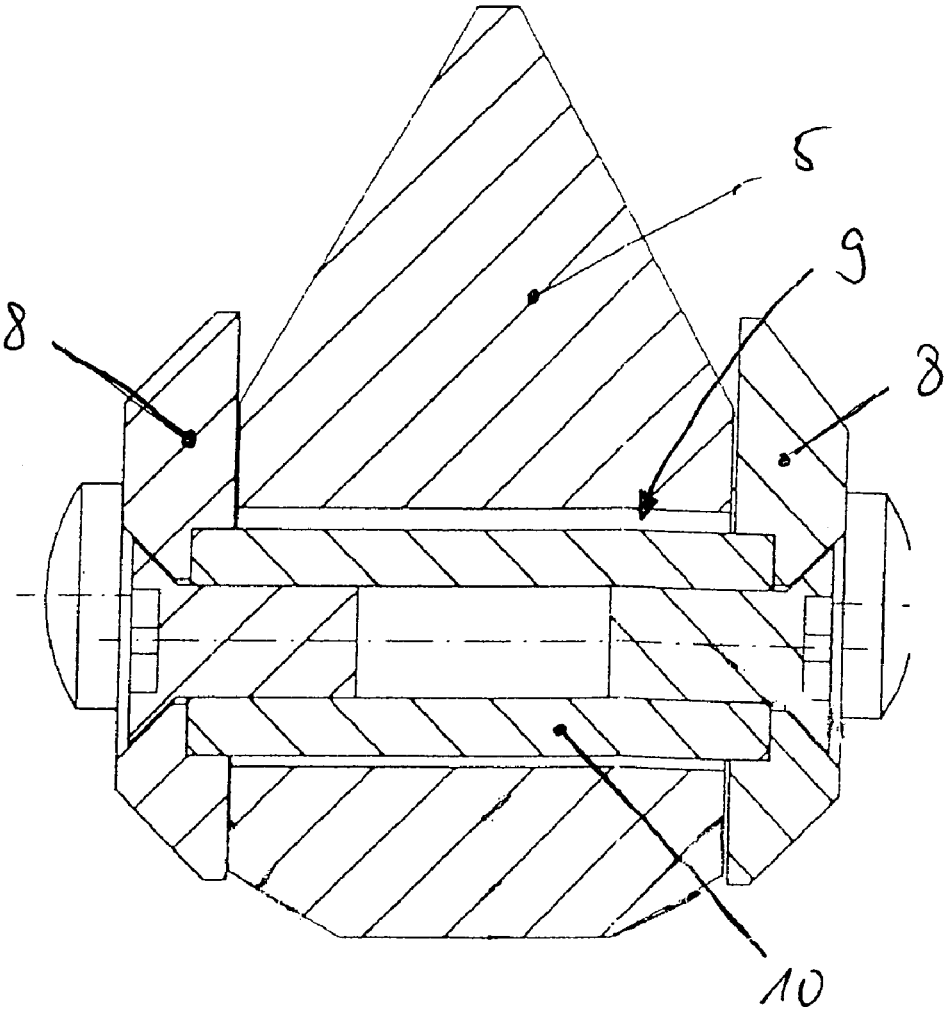
FIG. 4 shows a cross-sectional view through a clamping member with supporting element and pin through the plane of the slot.

FIG. 4 shows a cross-sectional view through a clamping member 5 with supporting elements 8 and pin 10 through the plane of the hole 9.

It is understood that the aforementioned features and the features specified in the claims can be used not only in the particular combinations that have been specified but also in other combinations or by themselves without exceeding the scope of the invention.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A printing cylinder having a central axis, a cylindrical surface, and axially opposite ends, the cylinder further comprising:

an axis-parallel channel in the cylinder, the channel narrowing toward the surface to form a slot for receiving the ends of a covering;

a clamping member arranged in the channel and urged toward the slot by springs, the clamping member having at least one recess facing a respective at least one wall of the channel;

at least one supporting element arranged inside the channel and engaging a respective said at least one recess of the clamping member; and a pair of adjusting elements arranged at the ends of the cylinder and supporting the clamping member so that the clamping member can be radially displaced, said adjusting elements being arranged so that movement of the adjusting elements causes relative movement between said at least one supporting element and the clamping member, whereby the clamping member is caused to move radially for clamping and unclamping the ends of the covering in the slot.

2. The printing cylinder of claim 1 further comprising at least one positioning element fixed to the cylinder and preventing axial movement of the clamping element.

3. The printing cylinder of claim 2 further comprising a radially extending oblong hole in the clamping member, the positioning element being received in the oblong hole.

4. The printing cylinder of claim 1 comprising at least one pair of supporting elements arranged against respective sides of the channel said at least one recess comprising at least one hole through the clamping element, each said pair of supporting elements being connected by a pin extending through a respective said hole in the clamping element.

5. The printing cylinder of claim 4 wherein said hole is an oblong hole which is inclined at an acute angle to the axis of the cylinder.

6. The printing cylinder of claim 1 wherein the adjusting elements can be adjusted in at least one of radial and axial directions.

* * * * *